US012140130B2

(12) United States Patent
Szarek

(10) Patent No.: US 12,140,130 B2
(45) Date of Patent: Nov. 12, 2024

(54) CRYOPANEL STRUCTURE FOR A CRYOPUMP

(71) Applicant: Edwards Vacuum LLC, Sanborn, NY (US)

(72) Inventor: Gerald Szarek, Chelmsford, MA (US)

(73) Assignee: Edwards Vacuum LLC, Sanborn, NY (US)

( * ) Notice: Subject to any disclaimer, the term of this patent is extended or adjusted under 35 U.S.C. 154(b) by 0 days.

(21) Appl. No.: 18/004,381

(22) PCT Filed: Jul. 6, 2021

(86) PCT No.: PCT/IB2021/056043
§ 371 (c)(1),
(2) Date: Jan. 5, 2023

(87) PCT Pub. No.: WO2022/009088
PCT Pub. Date: Jan. 13, 2022

(65) Prior Publication Data

US 2023/0279848 A1 Sep. 7, 2023

(30) Foreign Application Priority Data

Jul. 8, 2020 (GB) ..... 2010468

(51) Int. Cl.
*F04B 37/08* (2006.01)

(52) U.S. Cl.
CPC ..... *F04B 37/08* (2013.01)

(58) Field of Classification Search
CPC ..... F04B 37/08; F04B 37/085
See application file for complete search history.

(56) References Cited

U.S. PATENT DOCUMENTS 3,579,998 A * 5/1971 Thibault ..... F04B 37/08 62/55.5
4,341,079 A 7/1982 Bonn
(Continued)

FOREIGN PATENT DOCUMENTS

CN 106930924 A 7/2017
GB 2077362 A 12/1981
(Continued)

OTHER PUBLICATIONS

PCT Notification of Transmittal of the International Search Report and the Written Opinion of the International Searching Authority, or the Declaration, PCT International Search Report and PCT Written Opinion dated Sep. 20, 2021 for corresponding PCT application Serial No. PCT/IB2021/056043, 12 pages.
(Continued)

*Primary Examiner* — Lionel Nouketcha
(74) *Attorney, Agent, or Firm* — Westman, Champlin & Koehler, P.A.; Theodore M. Magee

(57) ABSTRACT

A cryopump comprising: a pump inlet, a two stage refrigerator; a first stage array thermally coupled to a first stage of said two stage refrigerator; and a cryopanel structure coupled to a second stage of said two stage refrigerator is disclosed. The cryopanel structure comprises at least three flat panels. The first stage array is mounted between the pump inlet and the cryopanel structure, and comprises a plurality of slats, the plurality of slats each being mounted such that a side of each of the plurality of slats closest to the cryopanel structure is substantially aligned and offset longitudinally with respect to a corresponding one of said at least three flat panels.

16 Claims, 1 Drawing Sheet

(56) References Cited

U.S. PATENT DOCUMENTS

| | | | | |
|---|---|---|---|---|
| 4,466,252 | A | 8/1984 | Hood | |
| 4,607,493 | A * | 8/1986 | Sukenobu | F04B 37/08 62/3.1 |
| 4,718,240 | A * | 1/1988 | Andeen | F04B 37/085 62/100 |
| 5,056,319 | A | 10/1991 | Strasser | |
| 2005/0274128 | A1 | 12/2005 | Kishorenath et al. | |
| 2013/0312431 | A1* | 11/2013 | Syssoev | B01D 8/00 62/55.5 |
| 2014/0250923 | A1 | 9/2014 | Takahashi | |

FOREIGN PATENT DOCUMENTS

| | | | |
|---|---|---|---|
| JP | S60222572 | A | 11/1985 |
| JP | S61123775 | A | 6/1986 |
| JP | H02191876 | A | 7/1990 |
| JP | H04159467 | A | 6/1992 |
| WO | 2019099862 | A1 | 5/2019 |
| WO | 2022009089 | A1 | 1/2022 |

OTHER PUBLICATIONS

British Examination Report and Search Report dated Nov. 30, 2020 for corresponding British application Serial No. GB2010468.3, 2 pages.

PCT Notification of Transmittal of the International Search Report and the Written Opinion of the International Searching Authority, or the Declaration, PCT International Search Report and PCT Written Opinion dated Sep. 20, 2021 for corresponding PCT application Serial No. PCT/IB2021/056044, 12 pages.

British Examination Report and Search Report dated Nov. 30, 2020 for corresponding British application Serial No. GB2010469.1, 2 pages.

* cited by examiner

CRYOPANEL STRUCTURE FOR A CRYOPUMP

CROSS-REFERENCE TO RELATED APPLICATION

This application is a Section 371 National Stage Application of International Application No. PCT/IB2021/056043 filed Jul. 6, 2021, and published as WO 2022/009088 A1 on Jan. 13, 2022, the content of which is hereby incorporated by reference in its entirety and which claims priority of British Application No. 2010468.3, filed Jul. 8, 2020.

FIELD

The field of the invention relates to cryopumps and in particular to two stage cryopumps having a first stage at a temperature for capturing type I gases such as water vapour, and a second stage at a lower temperature for capturing type II gases such as Nitrogen and in some embodiments for cryoadsorbing type III gases such as hydrogen.

BACKGROUND

A two stage cryopump is formed of a low temperature second stage cryopanel array. This may operate in the range of 4-25 K and may be coated with a capture material such as charcoal. This cryopanel array acts as the primary pumping surface and is surrounded by a first stage radiation shield that operates in a higher temperature range such as of 40-130 K, and provides radiation shielding to the lower temperature array and shields it from type I gases such as water vapour by capturing these gas molecules where they contact the array.

In this way gases entering the pump from the chamber are captured and a vacuum is generated within the pump vessel. One issue with cryopumps is that during operation their ability to capture gas molecules reduces as the capturing surfaces become saturated with gas molecules. Cryopumps are therefore regenerated periodically to release the captured gas molecules.

There are competing factors to consider when designing cryopumps, a high conductance of gas into the pump improves pumping speeds, however, it is advantageous to provide some shielding of the second stage cryopanels both from thermal radiation to reduce the thermal load on the cryopanels and from type I gases. Type I gases that reach the cryopanels condense on them blocking type III gases from being cryoadsorbed. Furthermore, some type I gases such as large chain hydrocarbons will not leave the array surface during a regeneration resulting in a reduction in pumping performance over the remaining life of the pump. Shielding of the cryopanels from gas molecules does however, result in a reduction in conductance.

It would be desirable to provide an improved two stage cryopump.

The discussion above is merely provided for general background information and is not intended to be used as an aid in determining the scope of the claimed subject matter. The claimed subject matter is not limited to implementations that solve any or all disadvantages noted in the background.

SUMMARY

A first aspect provides cryopump comprising: a pump inlet; a two stage refrigerator; a first stage array thermally coupled to a first stage of said two stage refrigerator; and a cryopanel structure coupled to a second stage of said two stage refrigerator; wherein said cryopanel structure comprises at least three flat panels; said first stage array being mounted between said pump inlet and said cryopanel structure, and comprising a plurality of slats, said plurality of slats each being mounted such that a side of each of said plurality of slats closest to said cryopanel structure is substantially aligned and offset longitudinally with respect to a corresponding one of said at least three flat panels.

When designing a cryopump it is desirable to provide a cryopanel structure with significant surface area to capture gas molecules and with a first stage or frontal array to provide some shielding of the cyopanel structure from thermal radiation and from some gas molecules entering the pump through the inlet. The cryopump inlet is conventionally of a circular cross section and the cryopanel structure has generally had a similar configuration, perhaps being formed of coaxial cylinders. Although such an arrangement has the advantage of symmetry and of matching well with a vacuum chamber outlet, it can be challenging to manufacture and build. Providing a planar second stage cryopanel array formed of flat panels with a first stage array formed of linear slats that are aligned with at least some of the panels, and longitudinally offset with respect to them, provides an arrangement that is simple to manufacture and easy to assemble. Furthermore, having an arrangement where the slats are substantially aligned with the panels provides both effective and targeted shielding of the panels. This arrangement can also provide a very high hydrogen pumping speed.

In some embodiments, each of said plurality of panels has a corresponding slat longitudinally aligned and offset with respect to it.

In some embodiments, said plurality of slats are mounted to extend at an angle of between 110° and 160° with respect to said flat panels towards said pump inlet.

Angling the slats such that they slope towards the pump inlet and a neighbouring panel provides effective shielding of the cryopanel structure.

In some embodiments, said plurality of slats are mounted such that at least some of said slats shield one surface of an adjacent flat panel of said cryopanel structure from gas molecules entering said pump through said pump inlet.

The slats may be arranged to shield a surface of an adjacent panel from direct impact from a gas molecule entering the pump. The gas molecule may bounce off another surface and impact the panel, but the panel is shielded from being the first surface that is impacted. This allows certain types of gas molecules such as type I gas molecules to be captured before they reach this surface. It may be that each panel has a slanted slat arranged longitudinally aligned with it. Or it may be that each panel except one end panel in the array has a corresponding slat associated with it. The end panel is at an end in the direction the panels are sloping from an edge close to the cryopanel structure towards. The slats provide shielding for the neighbouring panel that they are angled towards, so where there is no subsequent panel, then it may be that such a slat is dispensed.

In some embodiments, surfaces of said plurality of flat panels comprise coated portions coated with an adsorbent material and further portions that are not coated with said adsorbent material.

Type III gases are not condensed at the temperatures of either the first or second stage refrigerator and to capture these molecules adsorbent is required. In cryopumps the second stage array may be coated with adsorbent to adsorb these type III gases as well as capturing type II gases. The inventor of the present invention recognised that a problem with adsorbent coated surfaces in a cryopump is that over time they can become less effective as gas molecules are adsorbed on them. The adsorbent material is provided to capture type III gases and it is important that these gases contact these surfaces and are captured. However, in order to increase the time between regeneration cycles it would be desirable to inhibit any other gases from being captured by the adsorbent that could be condensed on other surfaces. Photoresist for example, is a gas that may be present when the cryopump is being used to evacuate a semiconductor processing chamber and this is adsorbed by the adsorbent surfaces on impact reducing their lifetime between regeneration.

The inventor of the present invention recognised that were some of the surfaces of the second stage cryopanels not to be coated and were gases such as photoresist to impact these surfaces first then they would be condensed on the non coated surfaces before they reached the adsorbent coated surface and thus, the lifetime of the adsorbent coated surface would be increased.

Thus, by providing a pump with some surfaces that are not coated, non type III gases may be condensed when they impact these non adsorbent coated surfaces, while the type III gases will bounce off the non coated surfaces and be adsorbed when they impact an adsorbent coated surface. In this way the adsorbent surfaces will adsorb predominantly type III gases and this will increase their effectiveness and the lifetime between regenerations and maintain a substantially stable pumping speed for longer. In effect by allowing at least some of the gases to impact a non coated surface, some of the gases such as photoresist will, never reach a coated surface and the coated surface will be protected from these gases and can be used to almost exclusively pump the type III gases which will bounce off the non coated surface, increasing the time between regenerations and providing a pump whose pumping speed does not degrade unduly over time.

In some embodiments, one surface of at least some of said panels is coated with said adsorbent and the other surface is not coated.

Coating just one surface provides for a system that is easy to manufacture. For some coating techniques such as where an adherent coating such as epoxy is provided and the adsorbent material is adhered to this, the coating of a single surface by placing the epoxy coated surface in contact with the adsorbent is far easier to do, than coating both surfaces would be.

In some embodiments, said coated surface is said surface shielded by an adjacent one of said plurality of slats.

Arranging the slats so that the coated surface is shielded by the slats, allows the coated surface and the adsorbent on it to be shielded from non type III gases such as photoresist that will impact and be captured by other surfaces first. This improves the lifetime of the adsorbent. The planar geometry provides for an effective system for shielding one surface while allowing the other to capture type III gases.

Furthermore, by leaving bare of adsorbent the surface that is not so effectively shielded by the first stage array, a situation where over time one surface of the pump is contaminated and loses adsorption properties at a higher rate than the other surface is avoided or at least inhibited. Such a situation would lead to the pump's pumping speed changing over time, which would require recalibration of the system and is generally not desirable.

In some embodiments, said plurality of slats are arranged substantially parallel to each other, and said plurality of flat panels are arranged substantially parallel to each other.

A planar arrangement where the panels and slats are substantially parallel to each other provides a device that is simple to manufacture and where flow is more predictable.

In some embodiments, said plurality of slats are sloped in a same direction to each other. In some embodiments there are the same number of slats as there are panels.

In some embodiments the panels and slats are equally spaced from each other within the pump. This leads to flow channels between panels and slats of substantially the same size allowing for more homogeneous flow and absorption by the slats.

In some embodiments, said plurality of panels are arranged to extend substantially parallel to a longitudinal axis of said pump.

The panels may be arranged substantially parallel to a longitudinal axis of the pump such that each panel receives a similar amount of gas molecules and one panel does not shield another panel unduly from gas molecules entering the pump.

In some embodiments, said plurality of slats and said plurality of panels are substantially rectangular.

Although the slats and panels may be a number of different shapes, in some cases they are rectangular. Rectangular panels are simple to manufacture, mount and coat and provide effective surfaces.

In some embodiments, said plurality of slats are configured to overlap when viewed through said pump inlet in a direction parallel to said flat panels.

The plurality of slats may be configured to overlap when viewed through the pump inlet along the longitudinal axis and in this way there is no line of sight between the pump inlet and the panels such that gas molecules will generally have impacted another surface before impacting a surface of the cryopanel structure. In this regard, gas molecules travelling substantially parallel to the angles of the slats may directly impact one surface of the panels, and it is in some embodiments, this surface of the panels that is not coated with an absorbent. In this way, the absorbent coated side of the panel is protected from direct impact from gas molecules.

In some embodiments, said plurality of panels are all substantially the same size.

In other embodiments, the slats and panels at either end of the array may be smaller than those towards the middle. In this regard the pump inlet has a circular cross section and it may be advantageous to increase the size of the panels towards the middle of the pump where there is a greater diameter. However, having panels and slats of different sizes leads to more complex manufacturing processes and in some cases it may be desirable to make them all the same size.

In some embodiments, said adsorbent material is configured to adsorb type III gases such as hydrogen, helium and neon.

In some embodiments, said adsorbent material comprises a molecular sieve that coats said coated surface.

In some embodiments, said adsorbent material comprises one of: charcoal, activated carbon, zeolite or a porous metal surface.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

The summary is provided to introduce a selection of concepts in a simplified form that are further described in the detailed description. This summary is not intended to identify key features or essential features of the claimed subject matter, nor is it intended to be used as an aid in determining the scope of the claimed subject matter.

BRIEF DESCRIPTION OF THE DRAWINGS

Embodiments of the present invention will now be described further, with reference to the accompanying drawings, in which.

DETAILED DESCRIPTION

Before discussing the embodiments in any more detail, first an overview will be provided.

A cryopump with a planar frontal array which comprises parallel sloped panels or slats allows the second stage structure when it is also a planar structure to be aligned with the frontal array. This can provide a very high hydrogen pumping speed. The disadvantage is that the full area of the inlet may not be used as effectively as would be the case with a circular arrangement.

The second stage array panels run across the pump and lie vertically aligned with the longitudinal axis of the pump. The first stage array comprises sloped panels or slats between the second stage array and the pump inlet arranged so that an edge closest to the second stage array is aligned with a corresponding one of the second stage panels. The slats are sloped so that the surfaces slope towards the pump inlet. In some embodiments, one side of the second stage panels are coated in charcoal and this side is fully blocked by the higher temperature (of the order of 80K) frontal array to direct impact by gas molecules entering the pump. Gases that are condensed at the temperature of the frontal array will impact that array and not proceed further, some may impact the non-charcoal coated surface of the second stage array and again will not proceed further. Type III gases such as hydrogen will bounce off these surfaces and will be adsorbed when they impact the charcoal coated surface. In this way the adsorbent coated surfaces will pump almost exclusively type III gases with the other surfaces collecting the other gases.

In some embodiments, the slats of the frontal array overlap when viewed along the longitudinal axis perpendicular to the cross section of the pump inlet. The amount of overlap will determine pumping speed and also how well the panels of the second stage array are shielded from first impact by a gas molecule entering the pump inlet. Embodiments of this pump are effective for evacuating semiconductor processing vacuum chambers such as those used for implant applications, and PVD (physical vapour deposition) processes.

Figure 1:
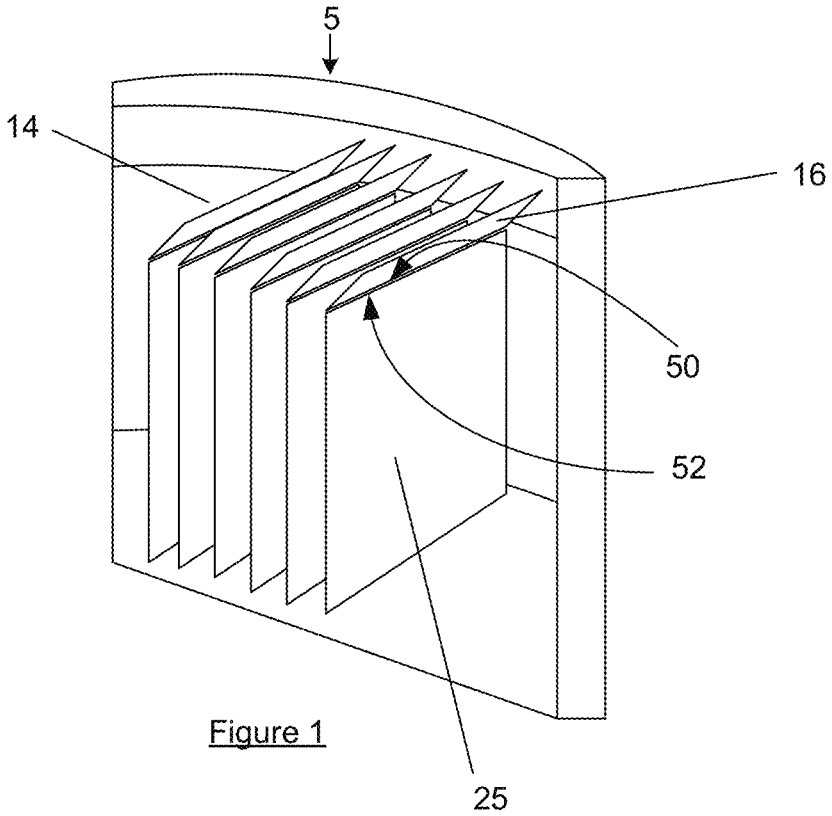
FIG. 1 shows a planar cryopanel structure according to an embodiment.
Figure 2:
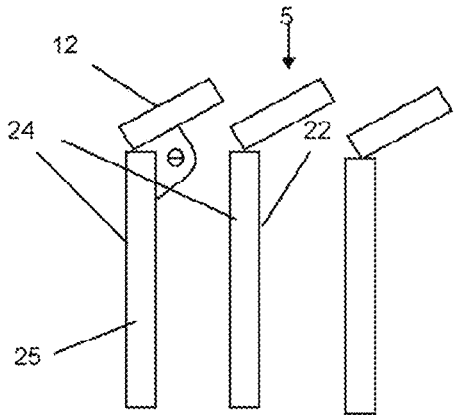
FIG. 2 shows the cryopanel structure of FIG. 1 and the frontal array.

FIGS. 1 and 2 show an embodiment of a cryopump with planar arrays formed of planar elements. FIG. 1 shows the parallel planar elements 25 of the second stage cryopanel structure within a pump having an inlet 5. The first stage frontal array 14 is shown to include a plurality of slats such as slats 12 and 16. The cryopanel structure of the second stage has parallel panels 25 arranged equally spaced from each other in a line. The plurality of slats are each sloped and have a lower edge, such as edge 50 of slat 16, that extends along a line that is parallel to a linear edge, such as edge 52, of a corresponding panel. The frontal array is longitudinally offset from the second stage array to thermally isolate the two arrays to a degree and lies between the second stage array and pump inlet 5.

In some embodiments, one side of the panels 25 are coated with an adsorbent and the other side not coated. The sloped elements of the frontal array protect the coated surface from initial impact by molecules entering through the pump inlet.

FIG. 2 schematically shows the frontal array elements 12 relative to the second stage array elements 25 and pump inlet 5. As can be seen slats 12 are mounted between the pump inlet 5 and the cryopanel structure of the second stage array. They are sloped so that they overlap when viewed from the pump inlet 5. The angle Θ between the slats 12 and panels 25 is between 110° and 160°, such that the slats lean towards an adjacent panel and shield the panel from gas molecules entering the pump inlet. There are gaps between the panels 12 that allow gas molecules to enter the pump.

In some embodiments both surfaces of panel 25 are coated with an adsorbent while in other embodiments, one surface 24 of the panels is coated with an adsorbent while the other surface 22 is not. The only direct path for a molecule travelling between the frontal array slats 12 leads to the uncoated surface 22 of the cryopanel structure, so that molecules entering through the pump inlet either impact a slat 12 first, or the uncoated surface 22 of the second stage array. Thus, initial impact of any molecule is not with coated surface 24 and molecules that condense at the temperature of the first or second stage refrigerator are captured on these surfaces. Other type III molecules bounce off these surfaces towards coated surface 24 where they are captured by the adsorbent coating on impact. In this way the coated surface of the second stage elements are shielded by the sloped first stage array slats 12 from initial impact by molecules entering the pump. Molecules not condensed on the first stage array or on the second stage array will impact the coated surface 22 and be captured by the adsorbent.

Although illustrative embodiments of the invention have been disclosed in detail herein, with reference to the accompanying drawings, it is understood that the invention is not limited to the precise embodiment and that various changes and modifications can be effected therein by one skilled in the art without departing from the scope of the invention as defined by the appended claims and their equivalents.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A cryopump comprising:

a pump inlet;

a two stage refrigerator;

a first stage array thermally coupled to a first stage of said two stage refrigerator; and a cryopanel structure coupled to a second stage of said two stage refrigerator; wherein said cryopanel structure comprises at least three flat panels;

said first stage array being mounted between said pump inlet and said cryopanel structure, and comprising a plurality of slats, said plurality of slats each being mounted such that a respective edge of each of said plurality of slats closest to said cryopanel structure extends along a first line and is offset longitudinally with respect to a top edge of a corresponding one of said at least three flat panels, wherein the top edge extends along a second line that is parallel to the first line.

2. The cryopump according to claim 1, wherein said plurality of slats are mounted to extend at an angle of between 110° and 160° with respect to said flat panels towards said pump inlet.

3. The cryopump according to claim 1, wherein said plurality of slats are mounted such that at least some of said slats shield one surface of an adjacent flat panel of said cryopanel structure from gas molecules entering said pump through said pump inlet.

4. The cryopump according to claim 1 wherein surfaces of said plurality of flat panels comprise coated portions coated with an adsorbent material and further portions that are not coated with said adsorbent material.

5. The cryopump according to claim 4, wherein one surface of at least some of said panels is coated with said adsorbent and the other surface is not coated.

6. The cryopump according to 5, wherein said plurality of slats are mounted such that at least some of said slats shield one surface of an adjacent flat panel of said cryopanel structure from gas molecules entering said pump through said pump inlet, said coated surface being said surface shielded by an adjacent one of said plurality of slats.

7. The cryopump according to claim 4, wherein said adsorbent material is configured to adsorb type III gases such as hydrogen, helium and neon.

8. The cryopump according to claim 4, wherein said adsorbent material comprises a molecular sieve that coats said coated surface.

9. The cryopump according to claim 4, wherein said adsorbent material comprises one of: charcoal, activated carbon, zeolite or a porous metal surface.

10. The cryopump according to claim 1, wherein said plurality of slats are arranged parallel to each other, and said plurality of flat panels are arranged parallel to each other.

11. The cryopump according to claim 1, wherein said plurality of panels are arranged to extend parallel to a longitudinal axis of said pump.

12. The cryopump according to claim 1, wherein said plurality of slats and said plurality of panels are rectangular.

13. The cryopump according to claim 1, wherein said plurality of slats are configured to overlap when viewed through said pump inlet in a direction parallel to said flat panels.

14. The cryopump according to claim 1, wherein said plurality of panels are all the same size.

15. The cryopump according to claim 1, wherein said plurality of slats are all the same size.

16. The cryopump according to claim 1, wherein said at least three panels form part of an array of panels comprising two outer panels and an inner panel between the two outer panels, the inner panel being larger than each of the two outer panels.

* * * * *